United States Patent [19]

Imrie

[11] 4,009,661

[45] Mar. 1, 1977

[54] MISSILE WARHEADS

[76] Inventor: Imrie Dodd, 110, Brampton Road, Bexley Heath, Kent, England

[22] Filed: Oct. 24, 1958

[21] Appl. No.: 769,510

[30] Foreign Application Priority Data

Oct. 24, 1957 United Kingdom ..... 33308/57

[52] U.S. Cl. ..... 102/61; 102/5; 102/7.2; 102/69; 244/3.27

[51] Int. Cl.² ..... F42B 13/50

[58] Field of Search ..... 102/5, 34.1, 50, 61; 89/1.7 A, 1.7 B

[56] References Cited

UNITED STATES PATENTS

| | | | |
|---|---|---|---|
| 609,003 | 8/1898 | Borelli | 244/3.27 |
| 1,108,717 | 8/1914 | Davis | 102/38 |
| 2,376,227 | 5/1945 | Brown | 102/5 |
| 2,492,279 | 12/1949 | Fowler | 102/46 |
| 2,645,999 | 7/1953 | Bogard | 60/253 |

FOREIGN PATENTS OR APPLICATIONS

| | | | |
|---|---|---|---|
| 1,148,066 | 6/1957 | France | 102/1.7 |
| 125,126 | 4/1917 | United Kingdom | 102/1.7 |

*Primary Examiner*—David H. Brown

EXEMPLARY CLAIM

3. A missile warhead having a pluraity of projector tubes, a pair of projectiles arranged back to back within each projector tube, each projectile having a plurality of spaced integral tongues extending longitudinally rearward thereof in normal unrestricted alignment, the tongues of the back to back projectiles formed to interfit into the spaces between the tongues of the other a propellant charge within the interfitting tongues, means for igniting the propellant charge to discharge the projectiles in opposite directions, said tongues being bendable outwardly under the action of the propellant gases upon leaving the projector tube to form stabilizing fins for the projectiles.

4 Claims, 6 Drawing Figures

Inventor,
By S. J. Rotondi & A. T. Rupert
Attorneys.

Inventor,
By Imrie Dodd
S. J. Rotondi & A. J. Dupont
Attorneys

Inventor,
S. J. Rotondi +
A. J. Dupont
By
Attorneys

Inventor,
By S. J. Rotondi & A. J. Duport
Attorneys.

MISSILE WARHEADS

This invention relates to missile warheads.

Its object is to provide a warhead which gives an improved chance of hitting the target, coupled with high lethality.

The invention therefore provides, in a missile warhead, a plurality of projectiles arranged to be projected outwardly by propellant charges initiated by the missile fuze.

The projectiles and their associated propellant charges may be so arranged that the projectiles "spread", somewhat in the manner of shot gun pellets, into any desired pattern. The pattern may be symmetrical about the line of flight of the missile or, if desired, may readily be arranged to give greater or even exclusive coverage in a zone or zones in which the target is more likely to appear. Variations in the pattern may be produced by varying the grouping of the projectiles in the warhead and/or by varying the propellant charges.

Although any shape of projectile may be used a substantially cylindrical projectile is preferred because of its easy construction and its good ballistic and penetrative properties. In order that the projectile axis may be orientated and maintained approximately along its line of flight a fin or tail portion may be provided.

In a preferred form therefore, the invention provides, in a missile warhead, a plurality of substantially cylindrical projectiles arranged to be projected outward by propellant charges initiated by the missile fuze, each projectile having a tail portion adapted to turn the projectile into its line of flight and thereafter to maintain the projectile axis approximately along the line of flight.

Each projectile may carry a high explosive or other filling and be fitted with a suitable fuze; for example an impact fuze which may contain a delay device to ensure that the burst occurs after penetration of the target skin. The noses of the projectiles may be of any suitable shape; for example they may be designed with cutting edges on the nose portion to achieve good penetration at large angles of incidence or otherwise adapted to deal with any particular type of target. The main missile fuze may conveniently be a forward looking proximity type fuze to ensure that the projectiles are ejected before the missile reaches its target. The missile and projectiles may, if desired, be fitted with a suitable self destruction device for safety reasons or to produce fragment patterns.

One form of the invention will now be more particularly described by way of example only, with reference to the accompanying drawings in which.

Throughout the drawings the same numeral has been used to indicate equivalent parts of the device.

Figure 1:
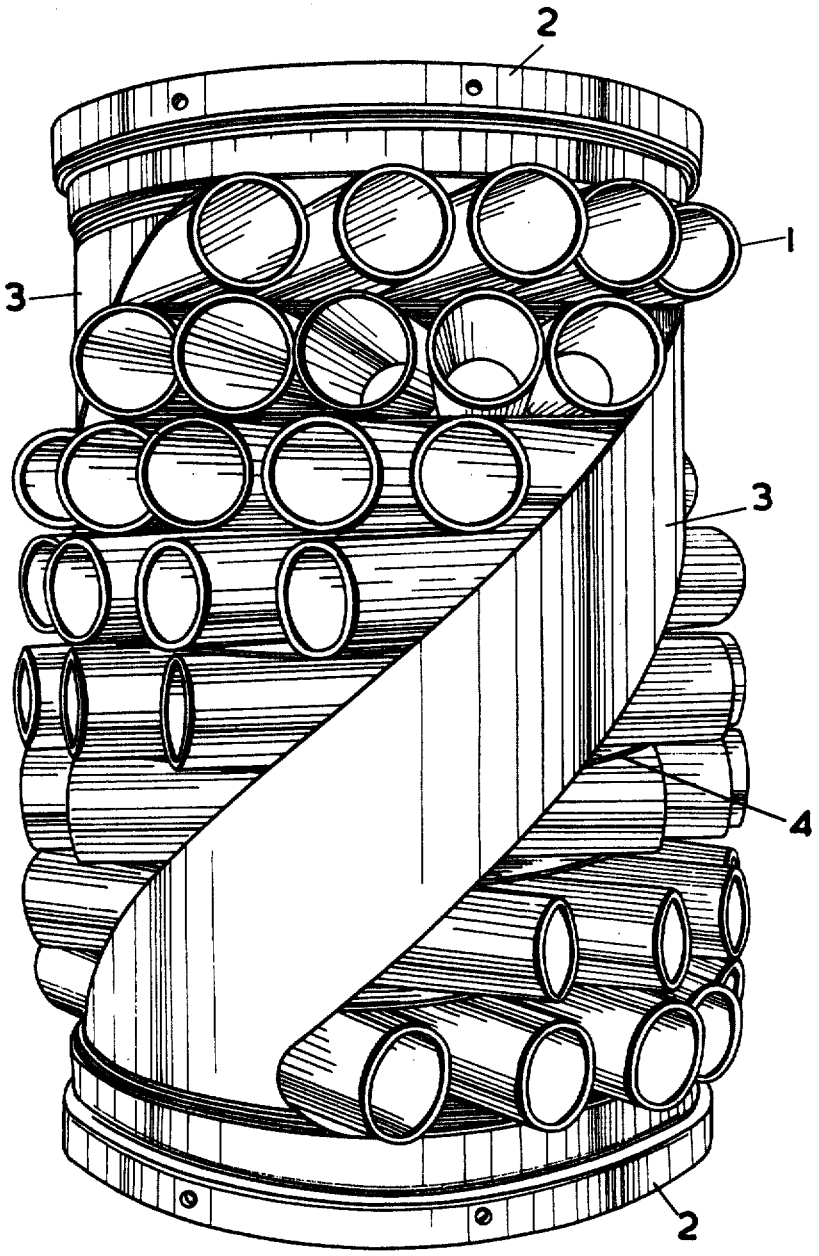
FIG. 1 is a side view of a simple form of projector tube assembly.

The assembly shown in FIG. 1 contains forty projector tubes 1 arranged in a spiral stack in eight banks each of five tubes. The tubes 1 (shown empty) are clamped in position between two metal clamping rings 2 connected by spiral metal straps 3 which retain the stack in its spiral form. The adjacent banks of tubes are separated by sheets of rubber 4 and the rings 2 have radial holes therein for attachment to a missile. This assembly is simple and provides a large number of projector tubes within a small space. However, the number and arrangement of the projector tubes and the supporting framework may be varied within very wide limits within the scope of the invention.

Figure 2:
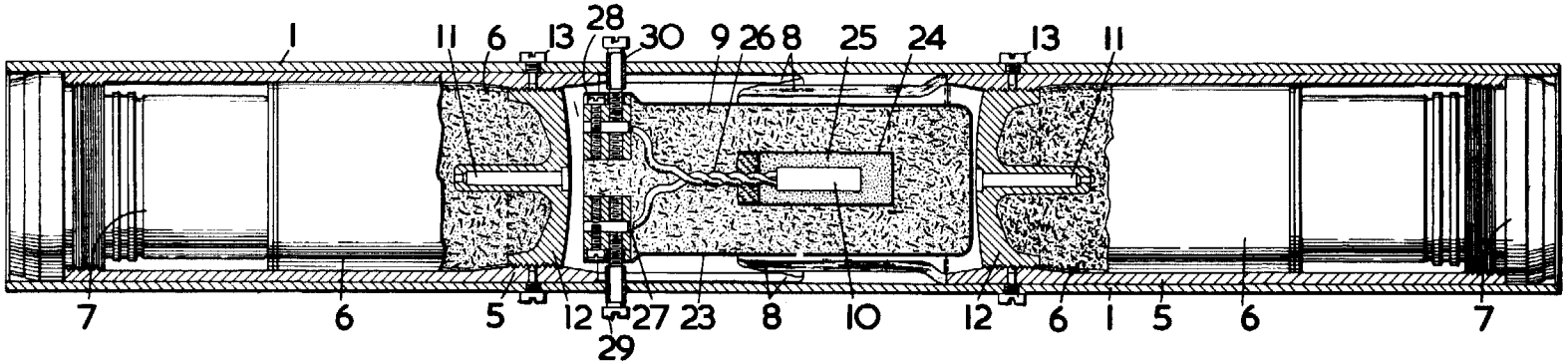
FIG. 2 is a section of single projector tube and its projectiles.

In a complete warhead each projector tube 1 contains, as shown in FIG. 2, a pair of projectiles arranged back to back. Each projectile has a hollow, tubular, steel casing 5 containing at its forward end a high explosive or other filling 6 and a suitable impact fuze 7. The rearward unfilled end of the casing is slit longitudinally to form a set of rearwardly facing tongues 8, the two projectiles of each pair being so formed that the tongues of one nest within the tongues of the other. The cylindrical space within the tongues contains a propellant charge 9. Interlocking of the projectiles in the above manner is not essential but enables the best use to be made of the available space. A suitable electrical igniter 10 is provided for each propellant charge 9 and is adapted to be initiated by the main missile fuze.

The charge 9 may be of any suitable design and in the form shown in FIG. 2 is carried in a container 23, the igniter 10 being situated approximately at its center and surrounded by a smaller container 24 carrying a priming charge 25. Leads 26 from the igniter 10 are carried to terminal blocks 27 and held in position by grub screws 28. For connection to the missile fuze terminal screws 29 are provided which pass through the projector tube 1, from which they are insulated by insulating tubes 30, into the terminal blocks 27. The terminal screws 29 also serve to support the charge assembly. Each projectile is also provided with a self destruction unit 11 housed in a bulkhead 12 which closes the projectile casing rearward of the explosive filling 6. The projectiles are retained in the projector tube 1 by small screws 13 which also serve to build up a shot start pressure before shearing to release the projectiles.

Figure 3:
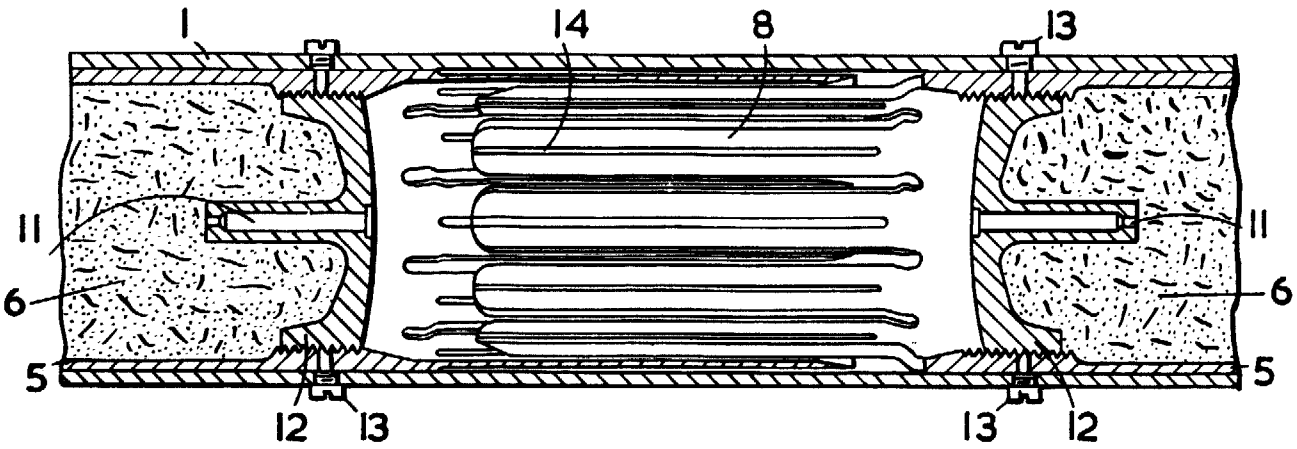

FIG. 3 is a more detailed view of the tails of a pair of projectiles showing more clearly the interlocking arrangement. The tongues 8 may if desired have longitudinal ribs 14 which can be formed by pressing and will provide greater resistance to bending. Furthermore the ribs 14 reduce the area of contact between the tongues 8 and the projector tube 1 hence reducing the risk of binding.

On firing the propellant charges 9 the projectiles in each projector tube 1 are propelled outward from the missile axis and, as each projectile leaves its enveloping tube the pressure of propellant gases on the inner surfaces of the tongues 8 causes them to fan out to form a tail. Each projectile may thus be subjected to a high lateral velocity which, added to the forward velocity of the missile, causes it to travel diagonally forward and its tail tends to orientate and maintain the projectile axis along its line of flight. The type of tail described occupies considerably less space than would a tail comprising fixed fins; and, being expanded by the action of the propellant gases, it opens more quickly than would mechanically operated folding fins. This rapid opening is essential since the time of flight is extremely short and therefore the stabilizing action of the tail must begin almost immediately after the projectile emerges from its projector tube. The tail has been found to give best results when the tongues after fanning out are substantially straight and lie at angles of about 45° to the axis of the projectile.

Figure 4:
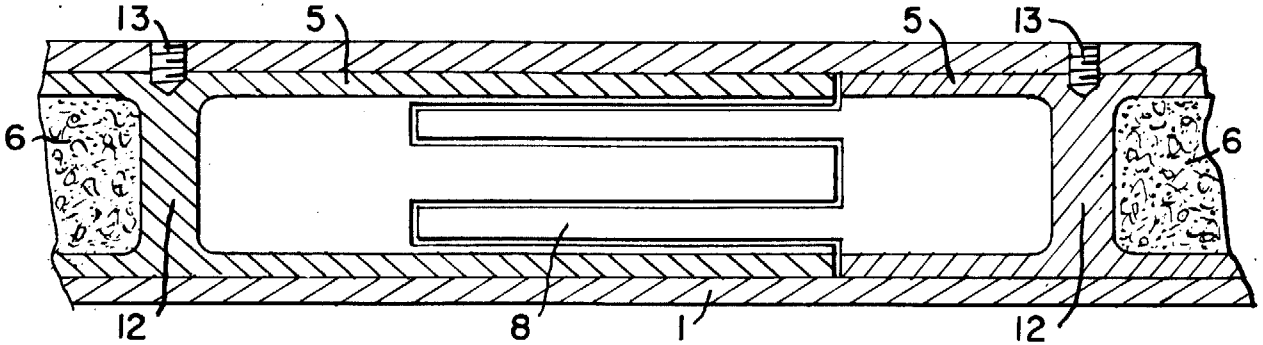
FIGS. 3 and 4 are sectional details showing alternative tail arrangements.

An alternative method of interlocking the two projectiles of a pair would be to make the tongues 8 in castellated form, as shown in FIG. 4, so that the tongues of one projectile fit into the spaces between tongues of the second projectile. This method, however, has the disadvantage of reducing the total tail area of each projectile and hence reducing the stabilising effect of the tail.

The above method of ejecting the projectiles from the warhead causes them to start their individual flight with considerable yaw which, however, is damped out quite quickly. If, however, some yaw remains until impact with the target the required penetration may still be obtained with suitably designed projectiles. Although the air drag forces acting on the projectiles will be considerable the time of free flight is so short that the retardation will not normally be sufficient to render them ineffective.

Figure 5:
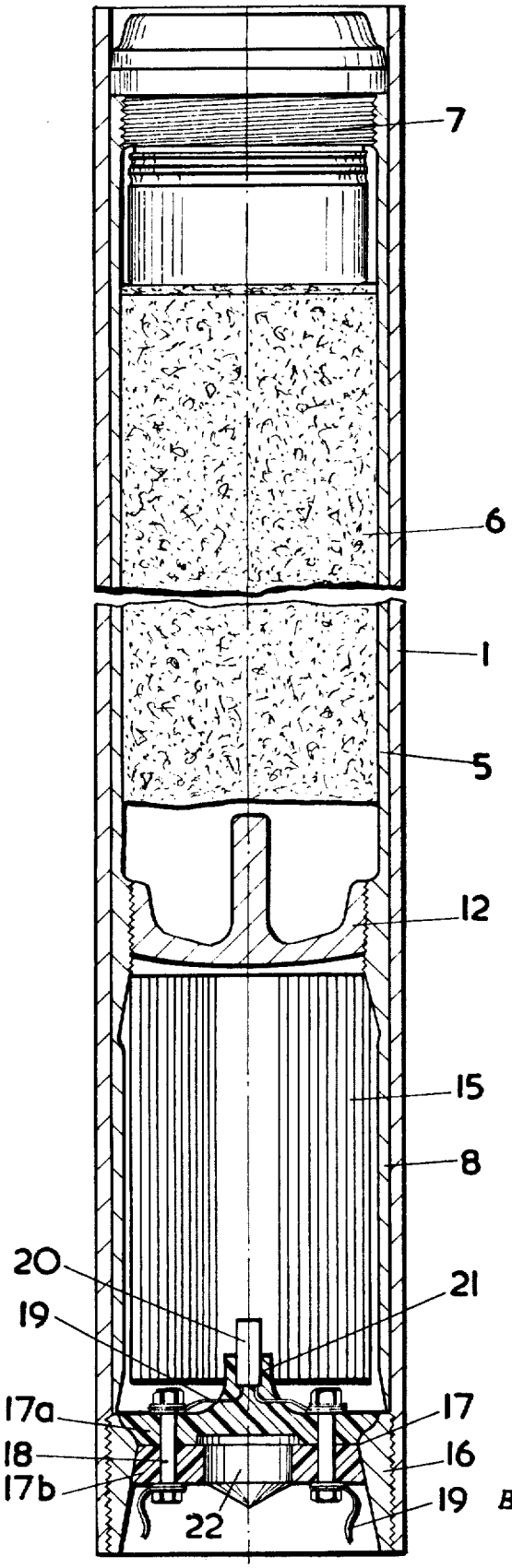
FIG. 5 is a broken section of a projector tube with a single projectile and recoilless projection system

The zone covered by the projectiles may be varied as previously described. If it should be desired to concentrate the projectiles on one side only of the missile the projector tubes may be arranged to eject single missiles by means of a recoilless system as shown in FIG. 5. In this case each projector tube 1 carries a single projectile substantially similar to those previously described with a propellant charge 15 in the cylindrical space within the tongues 8. A venturi tube 16 is screwed into the end of the projector tube 1 rearward of the projectile and the throat of the venturi is closed by a burster disc 17 which for ease of assembly is made in two parts 17*a*, 17*b* whose edges are shaped to fit the venturi tube forward and rearward respectively of the throat. The two parts 17*a*, 17*b* are held in position by bolts 18 which also serve as terminals to which leads 19 are connected for firing an electrical igniter 20 carried by a spigot 21 on the forward part 17*a* of the burster disc 17. A steel slug 22 held by a flange gripped between the two parts 17*a*, 17*b* of the burster disc 17 serves to puncture a hole in the missile skin to allow the exhaust gases to escape.

Figure 6:
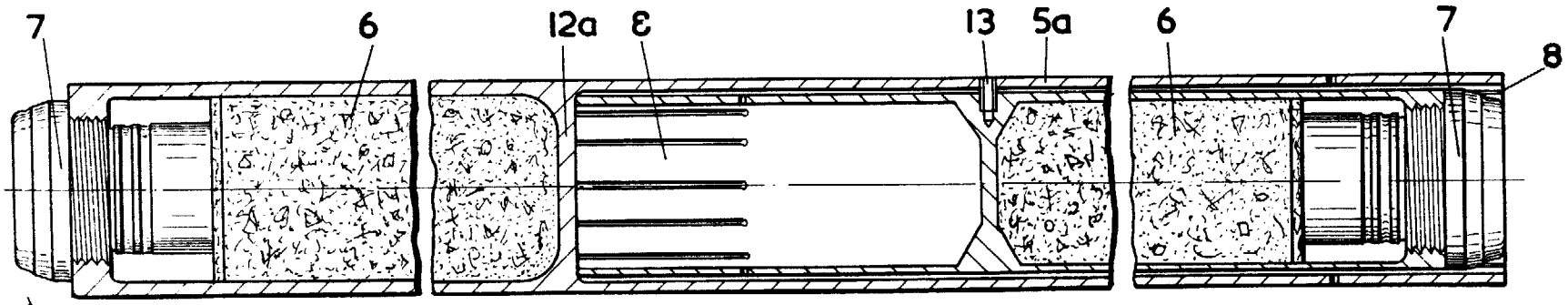
FIG. 6 is a broken section of an alternative arrangement of a pair of projectiles.

A further possible arrangement is shown in FIG. 6 in which the tubular casing 5*a* of one projectile is considerably extended rearward of the bulkhead 12*a*, the second projectile being of reduced diameter to allow its accomodation entirely within the elongated tail of the first projectile. With an arrangement of this type the outer projectile may take the place of the projector tube which can therefore be dispensed with. The fanning of the tongues 8 to form the tail takes place on separation of the two projectiles and would occur within the skin of a missile using this system which may be disadvantageous. The longer outer projectile would also have the disadvantage that the yaw damping effect of the tail would be less than on the shorter projectiles previously described.

The casing of the projectiles is preferably of high tensile steel to improve the penetrative properties while maintaining a large filling and the projector tubes may also be of high tensile steel to reduce the weight required to provide adequate strength. Alternatively the projector tubes may be made of a high specific strength plastic or the separate tubes may be replaced by cylindrical cavities within a plastic matrix.

Although impact fuzes are described herein as suitable for the individual projectiles any other suitable type of fuze may be used and although in the assembly shown in FIG. 1 the projector tubes 1 are shown perpendicular to the longitudinal axis of the warhead they may if desired be tilted at any desired angle to that axis.

The initiation system envisaged in the arrangement herein described is such as to provide substantially simultaneous ignition of all the propellant charges. For some purposes, however, it may be desirable to eject projectiles at small intervals over a short period of time, in which case a suitable delay system may be incorporated to ignite the propellant charges in succession or in any desired, staggered order.

I claim:

1. A missile warhead comprising a framework; a plurality of cylindrical projector tubes attached to the framework; a pair of projectiles arranged back to back within each projector tube, each projectile comprising a cylindrical casing, a fuze at the forward end of the casing, a filling within the casing, a bulkhead closing the casing rearward of the filling and a plurality of integral longitudinal tongues extending in unrestricted alignment rearwardly of the casing in a tubular formation, the tongue formation of one projectile of each pair being of smaller diameter than that of the other whereby one set of tongues fits telescopically within the other; a propellant charge within the tongue formations of the projectiles in each projectile tube, means for igniting each propellant charge to discharge the projectiles in opposite directions, said tongues being bendable outwardly under the action of the propellant gases upon leaving the projector tube to form stabilizing fins for the projectiles.

2. A missile warhead comprising a framework consisting of a forward clamping ring, a rearward clamping ring and two spiral straps connecting the clamping rings; a plurality of projector tubes arranged in a spiral stack between the clamping rings and within the spiral straps; a pair of projectiles arranged back to back within each projector tube, each projectile having a cylindrical casing, a fuze in the forward end of the casing, a filling within the casing, a bulkhead closing the casing rearward of the filling, a self destruction unit within the bulkhead and a plurality of longitudinal tongues extending rearwardly of the casing in tubular formation, the tongue formation of one projectile of the pair being of smaller diameter than that of the second projectile whereby the tongues of one projectile fit telescopically within the tongues of the second; a propellant charge within the tongue formations of the projectiles which charge comprises a container, a propellant filling within the container, a smaller container centrally positioned in the propellant filling, a priming charge within the smaller container, an electrical igniter embedded in the priming charge, a pair of terminal blocks within one end of the larger container and leads from the igniter to the terminal blocks; and a pair of terminal screws connected to the terminal blocks and extending through the projector tube and insulated therefrom for connection to leads from a main fuze.

3. A missile warhead having a plurality of projector tubes, a pair of projectiles arranged back to back within each projector tube, each projectile having a plurality of spaced integral tongues extending longitudinally rearward thereof in normal unrestricted alignment, the tongues of the back to back projectiles formed to interfit into the spaces between the tongues of the other a propellant charge within the interfitting tongues, means for igniting the propellant charge to discharge the projectiles in opposite directions, said tongues being bendable outwardly under the action of the propellant gases upon leaving the projector tube to form stabilizing fins for the projectiles.

4. A missile warhead comprising a circular framework, a plurality of projectile tubes attached to said framework, said tubes arranged in batteries, said batteries spirally arranged one below the other to cover the entire target area surrounding the circular framework, a pair projectiles in each projector tube arranged back to back, said projectiles having a plurality of integral tongues with spaces therebetween extending longitudinally rearward and unrestrained by the projector tube, said tongues of each back to back projectile arranged so that the tongues of one occupy the spaces between the tongues of the other, a propellant charge within the interfitting tongue formation, means for igniting the charge in each projector tube to discharge the projectiles of each tube in opposite directions, the tongues of each projectile being bendable outwardly to form stabilizing fins by the pressure of the propellant gases upon leaving the projector tubes.

* * * * *